US008979369B2

(12) United States Patent
Jenkins et al.

(10) Patent No.: US 8,979,369 B2
(45) Date of Patent: Mar. 17, 2015

(54) ADHESIVE CLOSURE STRIP FOR BULK MATERIAL PRODUCT BAG

(75) Inventors: Paul Michael Jenkins, Hendersonville, TN (US); David J. Anzini, Middletown, NY (US); Lars G. Wihlborg, Stratford, CT (US)

(73) Assignee: Illinois Tool Works Inc., Glenview, IL (US)

( * ) Notice: Subject to any disclaimer, the term of this patent is extended or adjusted under 35 U.S.C. 154(b) by 961 days.

(21) Appl. No.: 12/149,569

(22) Filed: May 5, 2008

(65) Prior Publication Data

US 2009/0274399 A1 Nov. 5, 2009

(51) Int. Cl.
*B65D 33/24* (2006.01)
*B65D 33/16* (2006.01)

(52) U.S. Cl.
CPC ..... *B65D 33/1691* (2013.01)
USPC ..... 383/98

(58) Field of Classification Search
CPC ..... B65D 33/10; B65D 31/10; B65D 5/069; B65D 3/20
USPC ..... 383/98, 125, 12, 13, 20, 21, 30, 78, 79, 383/83, 90, 84, 85, 87
See application file for complete search history.

(56) References Cited

U.S. PATENT DOCUMENTS

| | | | | |
|---|---|---|---|---|
| 2,051,106 | A * | 8/1936 | Rosen | 383/83 |
| 2,197,490 | A | 4/1940 | Williams et al. | |
| 2,524,030 | A * | 10/1950 | Allen | 383/210.1 |
| 3,228,585 | A * | 1/1966 | Fleming | 222/541.9 |
| 3,253,593 | A * | 5/1966 | Cronin, Jr. | 604/324 |
| 5,788,438 | A | 8/1998 | Goshorn et al. | |
| 5,908,275 | A | 6/1999 | Howlett, Jr. et al. | |
| 6,095,732 | A | 8/2000 | Howlett, Jr. et al. | |
| 6,432,495 | B1 | 8/2002 | Berrier et al. | |
| 2002/0154835 | A1 * | 10/2002 | Galomb | 383/10 |
| 2007/0292053 | A1 * | 12/2007 | Lin et al. | 383/78 |

FOREIGN PATENT DOCUMENTS

| | | |
|---|---|---|
| DE | 91 01 276 | 4/1991 |
| DE | 200 09 022 | 8/2000 |
| GB | 855449 | 11/1960 |
| GB | 2227226 | 7/1990 |
| GB | 2382562 | 6/2003 |

* cited by examiner

*Primary Examiner* — Christopher Demeree
(74) *Attorney, Agent, or Firm* — Law Offices of Steven W. Weinrieb

(57) ABSTRACT

A bulk material product bag has an adhesive closure strip fixedly secured thereon. As a result of the adhesive closure strip being oriented transversely across the normally open end region of the bulk material product bag so as to be adhesively bonded to both the back and front sides of the bulk material product bag, the adhesive closure strip effectively closes and seals the open end region of the bulk material product bag. Handle structure can also be integrally incorporated within the adhesive closure strip.

2 Claims, 15 Drawing Sheets

800

ADHESIVE CLOSURE STRIP FOR BULK MATERIAL PRODUCT BAG

FIELD OF THE INVENTION

The present invention relates generally to bulk material product bags, and more particularly to a new and improved bulk material product bag which has an adhesive closure thereon, wherein the adhesive closure comprises a strip which is adapted to effectively be folded in half, along its longitudinal extent, and which is adapted to be oriented transversely across an open end region of the bulk material product bag so as to be adhesively bonded to both the back and front sides of the bulk material product bag whereby the adhesive closure strip then effectively seals the open end region of the bulk material product bag to a closed and sealed state. The adhesive closure strip can have adhesive applied thereto, or alternatively, adhesive can be applied to the back and front sides of the bulk material product bag within the vicinity of the open end region thereof. The transverse extent of the adhesive closure strip can effectively match the transverse width dimension of the bulk material product bag such that the adhesive closure strip does not project or extend beyond the transversely spaced side edge portions of the bulk material product bag, or alternatively, the adhesive closure strip can extend beyond the transversely spaced side edge portions of the bulk material product bag so as to provide enhanced sealing and reinforcement to the closed and sealed end region of the bulk material product bag. The adhesive closure strip can be used in conjunction with flush-cut bulk material product bags, or alternatively, in conjunction with pinch-bottom bulk material product bags. Still further, the adhesive closure strip can be used in conjunction with gusseted or side-pleated bulk material product bags, or alternatively, in conjunction with non-gusseted or non-side-pleated bulk material product bags. Lastly, handle structure can be integrally incorporated or defined within the adhesive closure strip.

BACKGROUND OF THE INVENTION

In connection with the manufacture or fabrication of, for example, bulk material product bags, that is, single ply or multi-ply paper or thermoplastic bags which are adapted to be filled with and contain bulk material products, such as, for example, pet food, cat litter, bird seed, grass seed, or the like, the bags are conventionally manufactured or fabricated in such a manner that the oppositely disposed, originally open ends of the bags are usually subsequently closed, either at the bag manufacturing plant or at the product filling plant, by means of a suitable sewing or stitching operation or process wherein closure strips are secured over the open ends of the bag by means of the aforenoted stitching or sewing operation or process. For example, as can best be appreciated from FIGS. 1 and 2, a conventional or PRIOR ART bulk material product bag is disclosed and is generally indicated by the reference character 100. More particularly, the bulk material product bag 100 is seen to comprise a main body bag portion 102 into which the bulk material is to be charged and contained, and a closure strip 104 which is adapted to be fixedly secured to, for example, the open upper end region of the main body bag portion 102 by means of sewn stitching 106. While the originally open upper end region of the main body bag portion 102 is therefore now closed as a result of the fixation of the closure strip 104 to the open upper end region of the main body bag portion 102 by means of the sewn stitching 106, it is to be realized that the fixation of the closure strip 104 to the open upper end region of the main body bag portion 102 by means of the sewn stitching 106 does not result in the upper end region of the bulk material product bag 100 being, in effect, hermetically sealed.

More particularly, as can best be appreciated from FIG. 2, as a result of the aforenoted sewing or stitching operation, a plurality of equally spaced holes or apertures 108 are effectively formed within the closure strip 104 and the upper end region of the main body bag portion 102 when the sewing needle pierces the closure strip 104 and the upper end region of the main body bag portion 102. Accordingly, it can be appreciated that the originally open upper end region of the main body bag portion 102 is, in effect, only closed in a spotted manner by means of the individual stitches passing through the upper end region of the main body bag portion 102. It can therefore be appreciated still further that air, contaminants, or infestation can not only potentially infiltrate the bulk material product bag 100 at the spaced locales of the upper end region of the bulk material product bag 100 which are effectively defined between the individual stitches 106 passing through the holes or apertures 108, but in addition, air, contaminants, or infestation can likewise potentially infiltrate the bulk material product bag 100 through means of the holes or apertures 108 per se. It is also to be appreciated that the sewing or stitching process or operation can only be performed at relatively low line speed rates that effectively limit the production capacity of the production line forming and completing the filled and closed bulk material product bags.

Continuing still further, it is often desired to provide bulk material product bags with handle structures in order to facilitate the carrying of such bulk material product bags by consumers. One example of a conventional or PRIOR ART bulk material product bag, having handle structure incorporated thereon, is disclosed within FIG. 3 and is generally indicated by the reference character 200. The bulk material product bag 200 is substantially the same as the bulk material product bag 100 disclosed within FIGS. 1 and 2, except as will be noted hereinafter, and therefore, component parts of the bulk material product bag 200 which correspond to the component parts of the bulk material product bag 100 will be designated by corresponding reference characters except that they will be within the 200 series. More particularly, the bulk material product bag 200 is substantially the same as the bulk material product bag 100 disclosed within FIGS. 1 and 2 except for the fact that a thermoplastic, substantially U-shaped handle structure 210 has been fixedly attached to, for example, the upper end region of the bulk material product bag 200 as a result of base portions of the handle structure 210 having been secured to the bulk material product bag 200 by means of the sewn stitching 206. It is to be noted that the handle structure 210 has been secured to the bulk material product bag 200 in the aforenoted manner such that the handle structure 210 extends downwardly and is therefore effectively incorporated within the footprint or peripheral confines of the bulk material product bag 200, that is, the handle structure 210 does not project or extend outwardly beyond any peripheral edge portion, in particular, the upper edge portion, of the bulk material product bag 200. However, it can be appreciated still further that, in view of this particular orientation or disposition of the handle structure 210 with respect to the bulk material product bag 200, when the handle structure 210 is grasped by means of a consumer in order to lift the bulk material product bag 200, the handle structure 210 will effectively then extend or be oriented upwardly whereby the weight forces, acting upon the inverted handle structure 210, will effectively tend to dislodge, tear out, or separate the handle structure 210 from the sewn stitching 206.

A need therefore exists in the art for a new and improved bulk material product bag, and a closure therefore, wherein the closure not only closes the normally or originally open end region of the bulk material product bag, but in addition, actually serves to effectively hermetically seal the same against the penetration or infiltration of air, contaminants, and infestation; wherein the closure can be fixedly secured to the bulk material product bag by means of a fixation process which can be performed upon high-speed production lines; and wherein further, handle structure can effectively be incorporated within the overall structure of the bulk material product bag so as not to normally extend beyond the footprint or external peripheral edge or boundaries of the bulk material product bag and which will not transmit forces to the bulk material product bag which would tend to adversely affect the structural integrity of the bulk material product bag closure.

SUMMARY OF THE INVENTION

The foregoing and other objectives are achieved in accordance with the teachings and principles of the present invention through the provision of a new and improved bulk material product bag which has an adhesive closure fixedly secured thereon. The adhesive closure comprises a strip which is adapted to effectively be folded in half, along its longitudinal extent, and which is adapted to be oriented transversely across an open end region of the bulk material product bag so as to be adhesively bonded to both the back and front sides of the bulk material product bag whereby the adhesive closure strip then effectively seals the open end region of the bulk material product bag to a closed and sealed state. The adhesive closure strip can have adhesive applied thereto, or alternatively, adhesive can be applied to the back and front sides of the bulk material product bag within the vicinity of the open end region thereof. The transverse extent of the adhesive closure strip can effectively match the transverse width dimension of the bulk material product bag such that the adhesive closure strip does not project or extend beyond the transversely spaced side edge portions of the bulk material product bag, or alternatively, the adhesive closure strip can extend beyond the transversely spaced side edge portions of the bulk material product bag so as to provide enhanced sealing and reinforcement to the closed and sealed end region of the bulk material product bag. The adhesive closure strip can be used in conjunction with flush-cut bulk material product bags, or alternatively, in conjunction with pinch-bottom bulk material product bags. Still further, the adhesive closure strip can be used in conjunction with gusseted or side-pleated bulk material product bags, or alternatively, in conjunction with non-gusseted or non-side-pleated bulk material product bags. Lastly, handle structure can be integrally incorporated or defined within the adhesive closure strip.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 4:
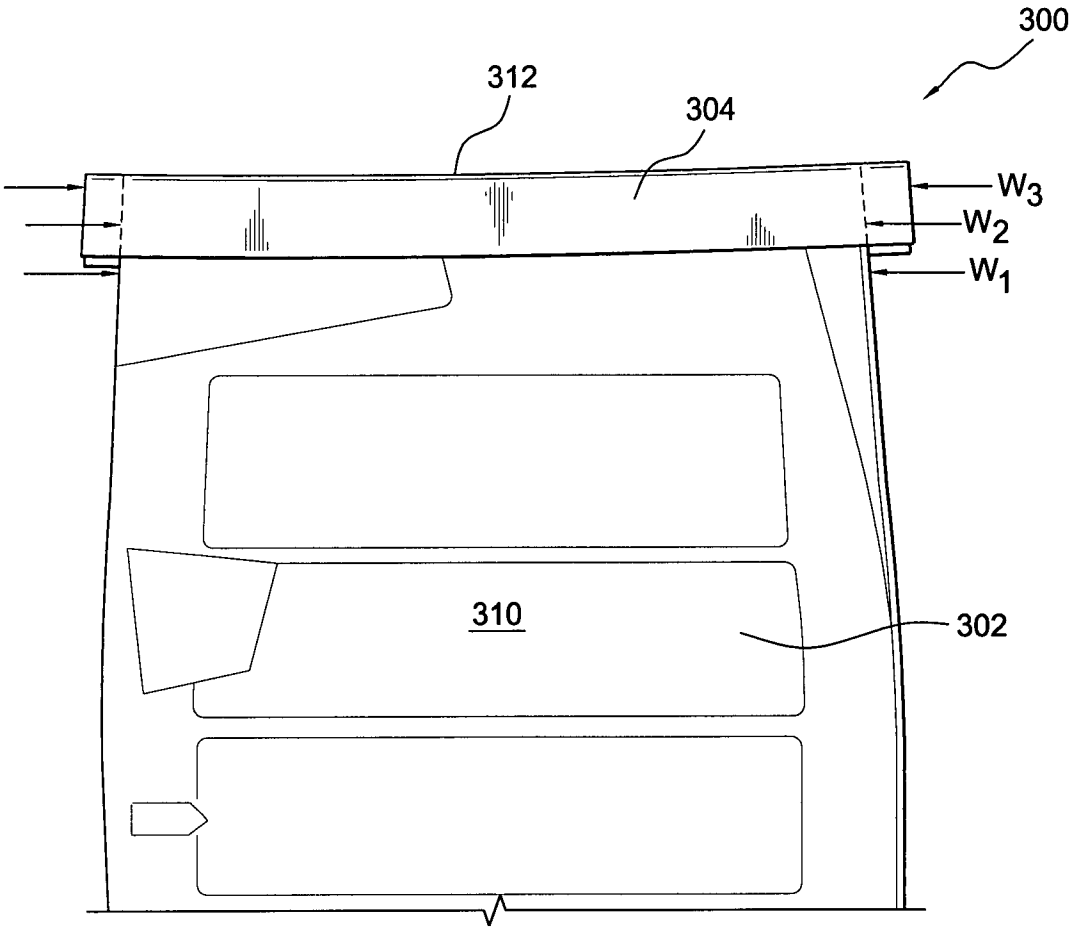
FIG. 4 is a front elevational view, similar to that of FIG. 1, showing, however, a first embodiment of a new and improved flush-cut, non-gusseted bulk material product bag, as constructed in accordance with the principles and teachings of the present invention and showing the cooperative parts thereof, wherein an adhesive closure strip has been fixedly secured to the back side or undersurface portion of, for example, the upper open end region of the bulk material product bag and folded over onto the front side surface portion of the bulk material product bag so as to be fixedly attached across, for example, the upper open end region of the bulk material product bag so as to close and seal the same.

Referring now to the drawings, and more particularly to FIG. 4 thereof, a first embodiment of a new and improved flush-cut, non-gusseted bag, which may be, for example, a bulk material product bag, as constructed in accordance with the principles and teachings of the present invention and showing the cooperative parts thereof, is disclosed and is generally indicated by the reference character 300. In view of the broad similarity of the bulk material product bag 300, as compared to, for example, the bulk material product bag 100 illustrated within FIGS. 1 and 2, except as will be noted hereinafter in accordance with the teachings and principles of the present invention, component parts of the bulk material product bag 300 which correspond to the component parts of the bulk material product bag 100 will be designated by corresponding reference characters except that they will be within the 300 series. More particularly, the first embodiment new and improved bulk material product bag 300 is seen to comprise a main body bag portion 302 into which the bulk material is to be charged and contained, and a closure strip 304 which is adapted to be fixedly secured to, for example, either the open upper end region of the main body bag portion 302, the open lower end region of the main body bag portion 302, or both of the open upper and lower end regions of the main body bag portion 302, although for the purposes of this disclosure, the closure strip 304 will be described as being applied or attached to the upper open end region of the main body bag portion 302. In view of the fact that the bulk material product bag 300 comprises a flush-cut bag which comprises, for example, a tubular construction, fabricated either from a suitable paper product, a suitable thermoplastic material, or a combination thereof, and wherein the longitudinal extent or length dimension of the upper or front side sheet member 310 of the main body bag portion 302 is the same as the longitudinal extent or length dimension of the bottom or back side sheet member, not visible, of the main body bag portion 302, it is to be appreciated that the upper or front side sheet member 310 of the main body bag portion 302 is longitudinally aligned with respect to the bottom or back side sheet member, not visible, of the main body bag portion 302 such that the upper or front side sheet member 310 of the main body bag portion 302 and the bottom or back side sheet member, not visible, of the main body bag portion 302 are not longitudinally offset with respect to each other.

Figure 1:
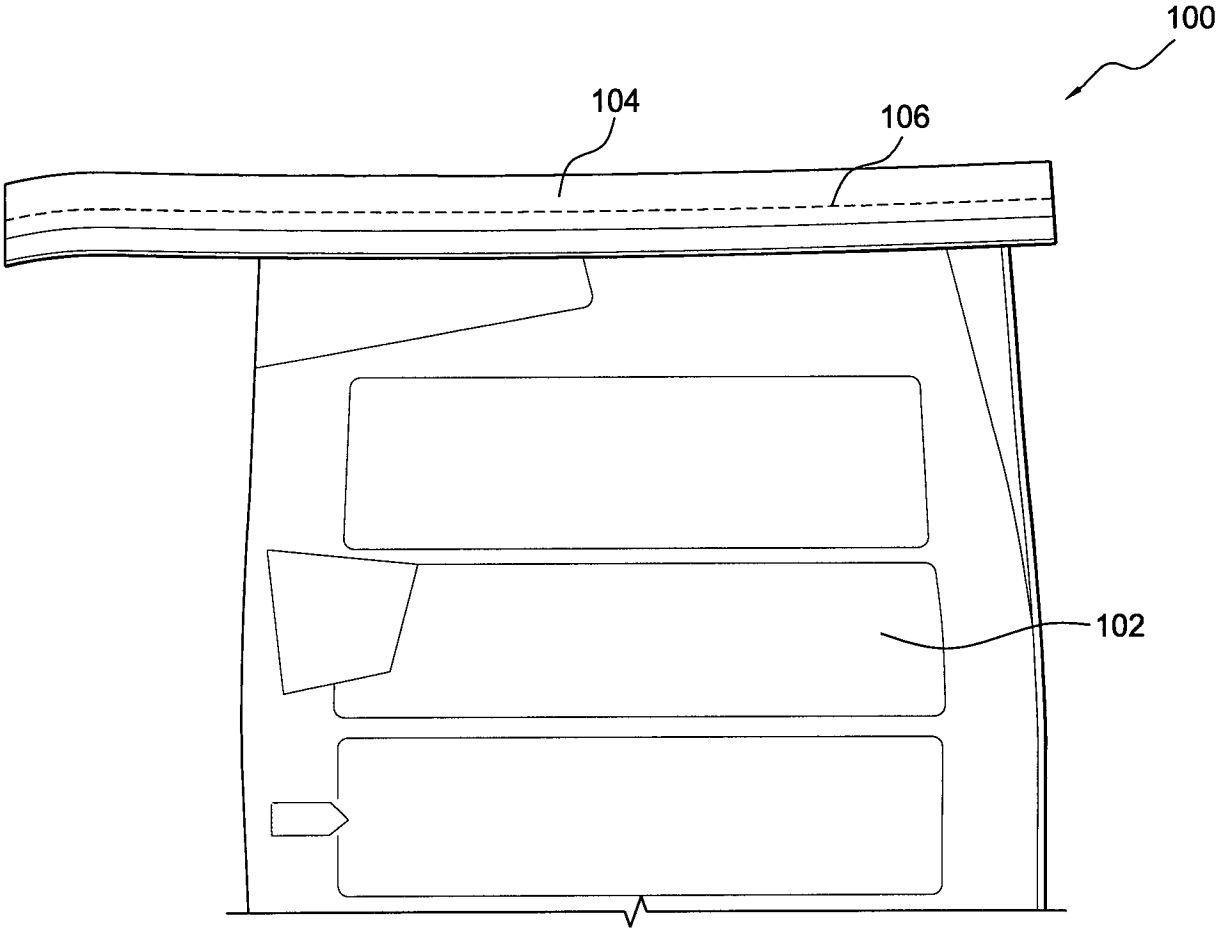
FIG. 1 (PRIOR ART)
FIG. 1 is a front elevational view of a conventional PRIOR ART bulk material product bag having, for example, its upper end portion closed by means of a closure strip which is secured thereto by means of sewn stitching.
Figure 2:
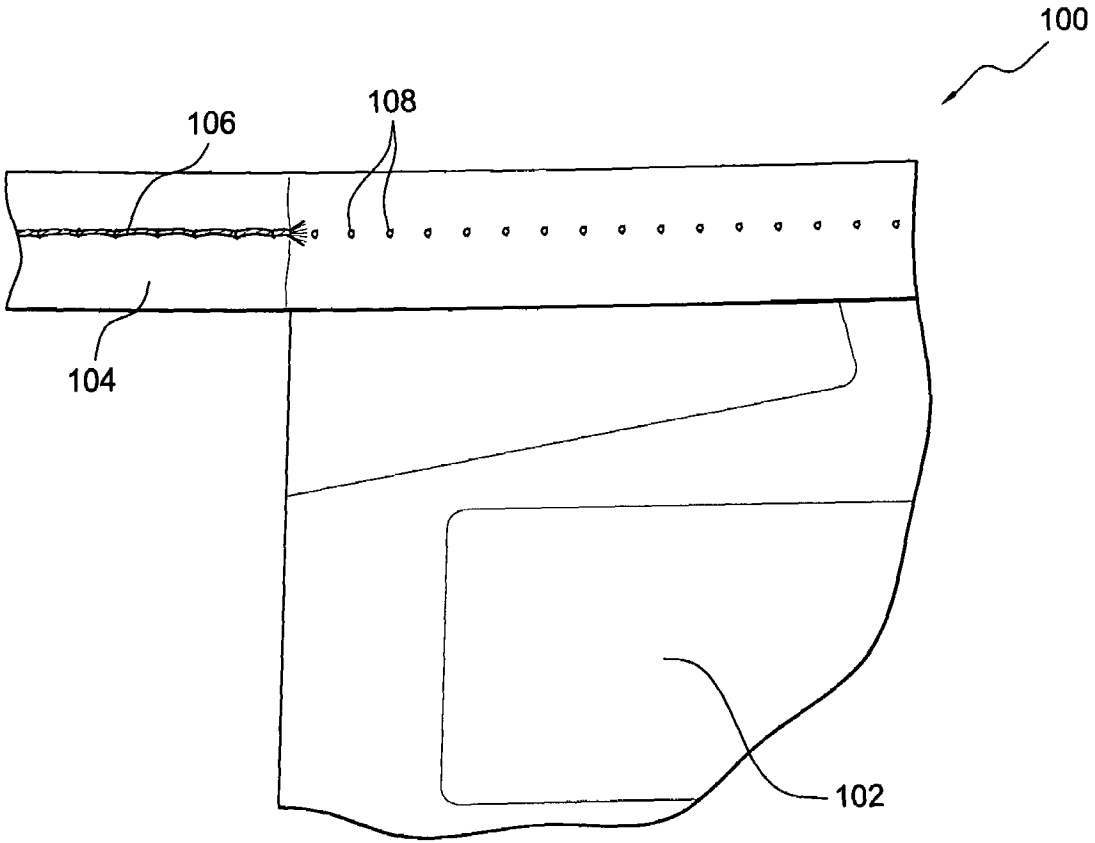
FIG. 2 (PRIOR ART)
FIG. 2 is an enlarged, partial view of the conventional PRIOR ART bulk material product bag as disclosed within FIG. 1 wherein, however, part of the sown stitching has been removed from the sewn closed upper end portion of the bulk material product bag so as to illustrate the details of the sewn stitching and the needle holes or apertures which extend through the closure strip as well as the upper end portion of the bulk material product bag.

Continuing further, it has been previously noted that in conjunction with the fabrication of, for example, conventional bulk material product bags, as disclosed at 100 within FIGS. 1 and 2, various fabricational and operational drawbacks or disadvantages are characteristic of such conventional bulk material product bags 100. Therefore, in accordance with the principles and teachings of the present invention, when the closure strip 304 is to be fixedly secured or attached to the upper end region of the main body bag portion 302 in order to close the originally open upper end region of the main body bag portion 302, in lieu of the closure strip 304 being affixed to the main body bag portion 302 by means of a sewing or stitching operation or process, the closure strip 304 is adapted to be, for example, adhesively bonded across the originally open upper end region of the main body bag portion 302. More particularly, as can readily be appreciated from FIG. 4, when the closure strip 304 is to be adhesively bonded across the originally open upper end region of the main body bag portion 302, a first portion of the closure strip 304 will initially be adhesively bonded to, for example, the external surface portion of the bottom or back side member, not visible, of the main body bag portion 302 which is disposed within the vicinity of, for example, the originally upper open end region of the main body bag portion 302, the closure strip 304 will then be folded over upon itself along its longitudinal extent so as to have a substantially V-shaped cross-sectional configuration such that the free end portions of the top or front side member 310 and the bottom or back side member, not visible, of the main body bag portion 302 are disposed within the internal region of the apex portion 312 of the closure strip 304, and subsequently, a second portion of the closure strip 304 is adhesively bonded to the external surface portion of the front side member 310 of the main body bag portion 302.

It is to be noted that in accordance with the various principles and teachings of the present invention, the closure strip 304 may comprise an adhesive closure strip wherein, for example, the adhesive closure strip 304 may have a suitable adhesive already integrally disposed thereon and may comprise, for example, a suitable adhesive tape or similar structure, or alternatively, the closure strip 304 may be adhesively bonded to the external surface portions of the top or front side member 310, and the bottom or back side member, not visible, of the main body bag portion 302 as a result of a suitable adhesive being applied either to the internal surface portions of the closure strip 304, or to the external surface portions of the top or front side and bottom or back side members of the main body bag portion 302, or both, at the time that the closure strip 304 is to be applied to the main body bag portion 302 in order to close the same. As can be readily appreciated still further, and contrary to the application of the closure strip 104 to the bulk material product bag 102 as disclosed within FIGS. 1 and 2, as a result of the application of the adhesively bonded closure strip 304 to the main body bag portion 302, the originally open end portion of the bulk material product bag 302 is not only now closed but is also effectively hermetically sealed.

It is lastly noted in connection with this first embodiment bulk material product bag 300 that the lateral or transverse extent or width dimension of the adhesively bonded closure strip 304 can either be the same as or match the lateral or transverse extent or width dimension $W_1$ of the main body bag portion 302, as denoted by means of the dotted lines $W_2$, or alternatively, the lateral or transverse extent or width dimension of the adhesively bonded closure strip 304 can be greater than that of the main body bag portion 302 so as to extend or project beyond the side edge portions of the main body bag portion 302 as denoted by the width dimension $W_3$. It is to be noted that when the adhesive closure strip 304 extends or projects beyond the side edge portions of the main body bag portion 302 so as to have a greater width dimension than that of the main body bag portion 302, the presence of the extra or additional material comprising the adhesively bonded closure strip 304 serves to provide enhanced reinforcement to, for example, the upper end portion of the main body bag portion 302. In addition, as a result of the actual encapsulation of those side edge portions of the main body bag portion 302 which are disposed within the immediate vicinity of the originally open end portion of the main body bag portion 302, enhanced sealing of the bulk material product bag 300 is also achieved. Still yet further, in the case that the adhesive closure strip extends beyond the side edge portions of the main body bag portion 302, and if adhesive is actually applied to the upper external surface portions of the of the top or front side and bottom or back side members of the main body bag portion 302, then additional adhesive is preferably applied to the internal surface portions of the adhesive closure strip 304 which do extend beyond the side edge portions of the main body bag portion 302.

Figure 5:
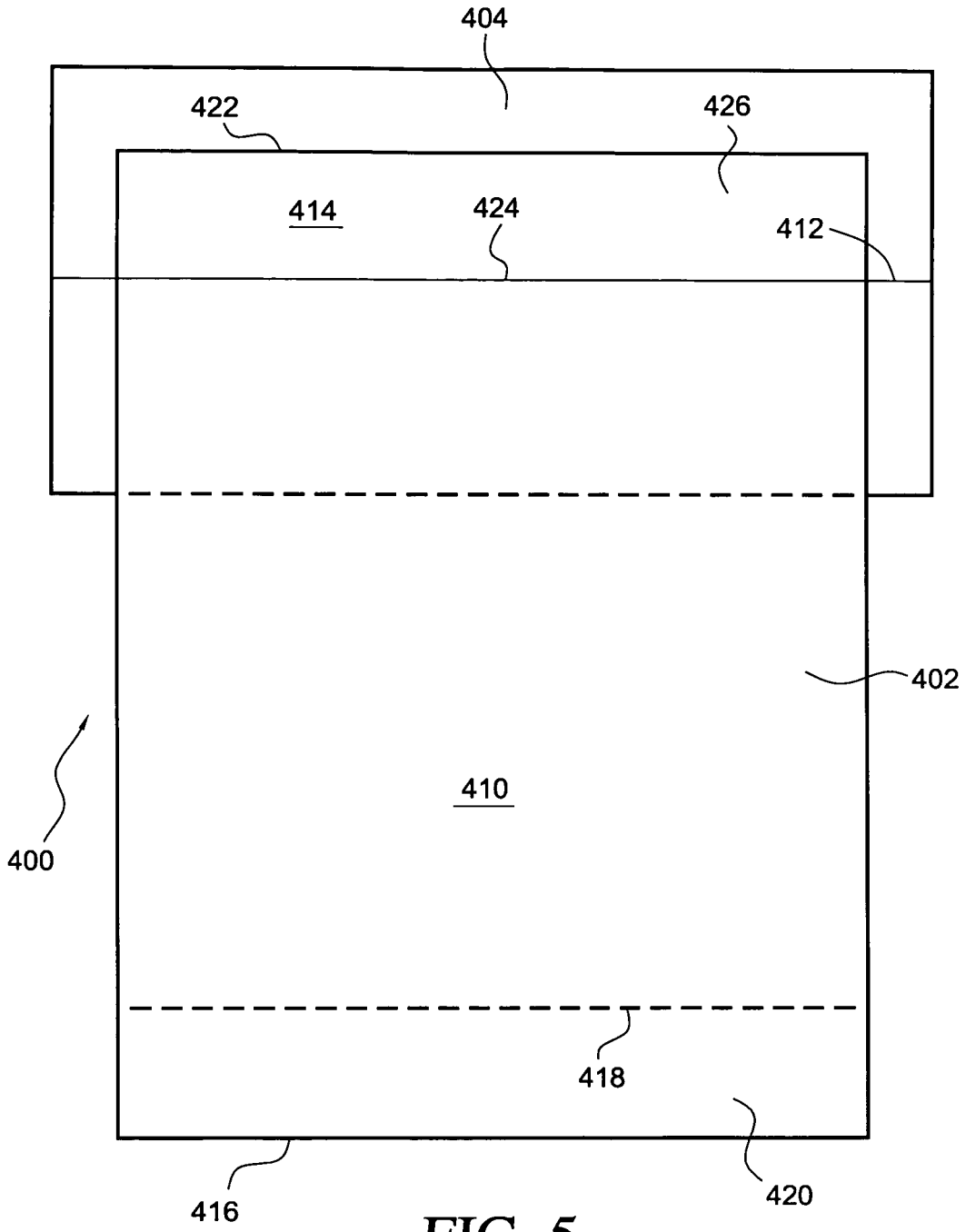
FIG. 5 is a front elevational view, similar to that of FIG. 4, showing, however, a second embodiment of a new and improved pinch-bottom, non-gusseted bulk material product bag, as constructed in accordance with the principles and teachings of the present invention and showing the cooperative parts thereof, wherein the adhesive closure strip has been fixedly secured to the back side or undersurface portion of, for example, the upper open end region of the bulk material product bag prior to the folding over of the adhesive closure strip, along with, for example, the upper end flap portion of the bulk material product bag, so as to fixedly secure the adhesive closure strip onto the front side surface portion of the bulk material product bag.

With reference now being made to FIG. 5, a second embodiment of a new and improved pinch-bottom, non-gusseted bag, which may be, for example, a bulk material product bag, as constructed in accordance with the principles and teachings of the present invention and showing the cooperative parts thereof, is disclosed and is generally indicated by the reference character 400. In view of the similarity of the second embodiment bulk material product bag 400, as compared to, for example, the first embodiment bulk material product bag 300 illustrated within FIG. 4, except as will be noted hereinafter in accordance with the teachings and principles of the present invention, component parts of the second embodiment bulk material product bag 400 which correspond to the component parts of the first embodiment bulk material product bag 300 will be designated by corresponding reference characters except that they will be within the 400 series. More particularly, the pinch-bottom, non-gusseted bulk material product bag 400 comprises an initially flattened tubular construction which has or is formed by a top or front side member 410 and a bottom or back side member 414. In addition, it is seen that while the longitudinal extents or length dimensions of the top or front side member 410 and the bottom or back side member 414 of the bulk material product bag 400 are substantially equal, they are longitudinally offset with respect to each other such that, for example, the lower edge portion 416 of the top or front side member 410 extends or projects beyond the lower edge portion 418 of the bottom or back side member 414 as to effectively form a lower flap member 420, and in a similar manner, the upper edge portion 422 of the bottom or back side member 414 extends or projects beyond the upper edge portion 424 of the top or front side member 410 as to effectively form an upper flap member 426.

Accordingly, when a closure strip 404, similar to the closure strip 304 as disclosed in connection with the first embodiment bulk material product bag 300, is to be fixedly attached or secured to the bulk material product bag 400, the adhesive closure strip 404 will initially be fixedly secured to the external surface portion of the bottom or back side member 414 of, for example, the upper open end region of the main body bag portion 402 of the bulk material product bag 400, and subsequently, the adhesive closure strip 404, along with, for example, the upper flap member 426 of the main body bag portion 402, is folded over upon itself, along fold line 412, so as to permit the adhesive closure strip 404 to be fixedly secured onto the external surface portion of the top or front side member 410 of the main body bag portion 402 of the bulk material product bag 400. An adhesive closure strip, not illustrated but similar to the adhesive closure strip 404, may likewise be applied to the bottom end region of the bulk material product bag 400 in order to fold over and fixedly secure the lower flap member 420 to the external surface portion of the bottom or back side member 414 of the main body bag portion 402 when the bottom end region of the bulk material product bag 400 is to likewise be closed and sealed.

Figure 6:
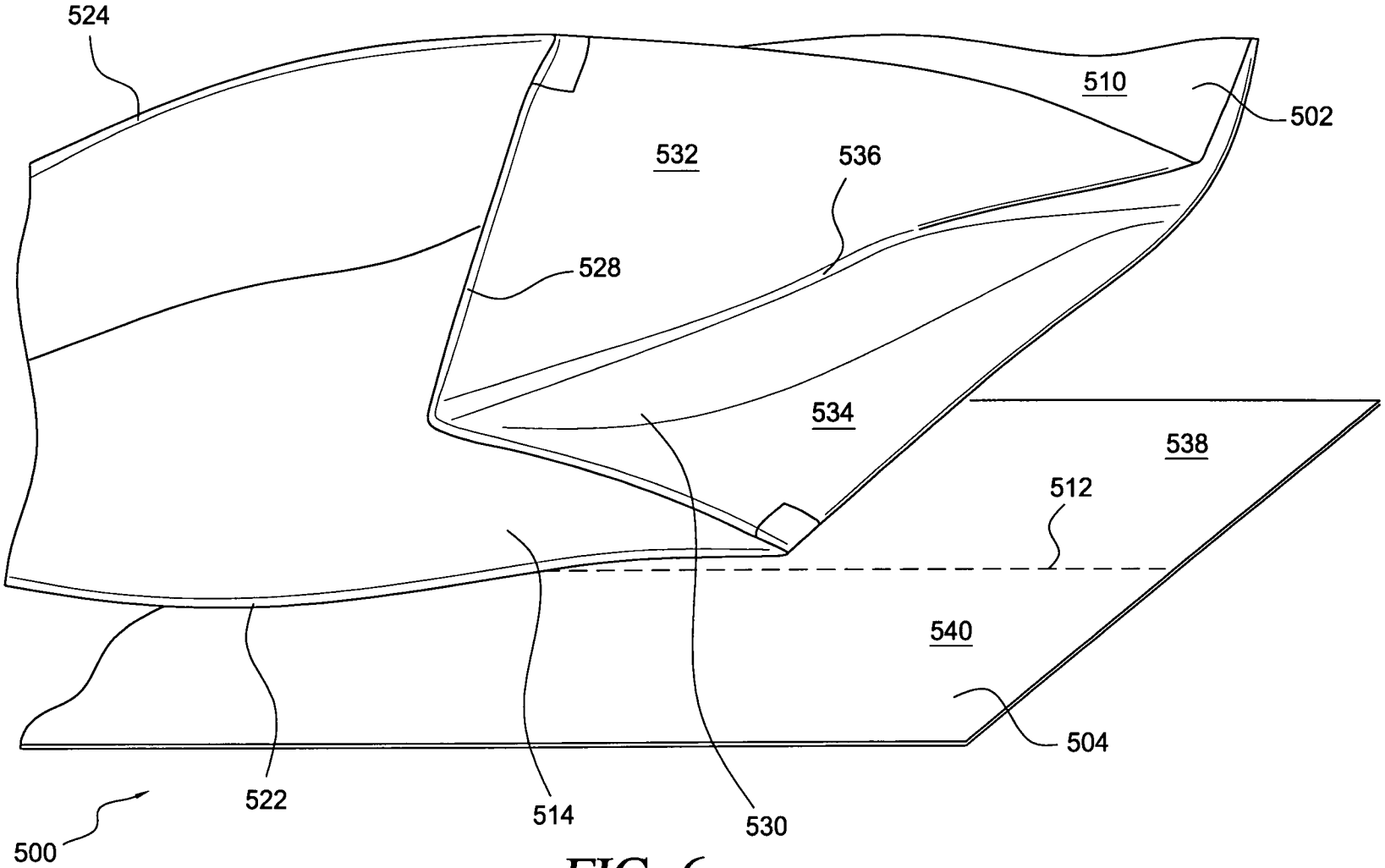
FIG. 6 is an upper end perspective view of a third embodiment of a new and improved flush-cut, gusseted bulk material product bag, as constructed in accordance with the principles and teachings of the present invention and showing the cooperative parts thereof, wherein the adhesive closure strip has been fixedly secured to the back side or undersurface portion of, for example, the upper open end region of the bulk material product bag prior to the compaction of the gussets or side pleats of the bulk material product bag and the folding over of the adhesive closure strip onto the front side surface portion of the bulk material product bag so as to fixedly attach the adhesive closure strip across the upper open end region of the bulk material product bag in order to close and seal the same.

Referring now to FIG. 6, a third embodiment of a new and improved flush-cut, gusseted bag, which may be, for example, a bulk material product bag, as constructed in accordance with the principles and teachings of the present invention and showing the cooperative parts thereof, is disclosed and is generally indicated by the reference character 500. In view of the similarity of the third embodiment bulk material product bag 500, as compared to, for example, the first and second embodiment bulk material product bags 300 and 400 as illustrated within FIGS. 4 and 5, except as will be noted hereinafter in accordance with the teachings and principles of the present invention, component parts of the third embodiment bulk material product bag 500 which correspond to the component parts of the first and second embodiment bulk material product bags 300 and 400 will be designated by corresponding reference characters except that they will be within the 500 series. More particularly, it is seen that the bulk material product bag 500 comprises a main body bag portion 502 which is formed by means of a top or front side member 510 and a bottom or back side member 514, and that the top or front side member 510 and the bottom or back side member 514 respectively have upper edge portions 524 and 522 which define, for example, the bulk material product opening 528 within the upper end portion of the bulk material product bag 500 and through which the bulk material product is to be charged into the main body bag portion 502.

In addition, it is also seen that the main body bag portion 502 is provided with inwardly folded pleats or gussets 530 upon opposite side edge portions thereof, only the left pleat or gusset 530 being visible, and that the each one of the folded pleats or gussets 530 is comprised of first and second inwardly folded pleated or gusseted members 532,534 which are integrally connected to each other along a longitudinally extending fold line 536. Still further, it is also seen that the edge portion of the pleated or gusseted member 532, which is remote from the fold line 536, is also integrally connected to the top or front side member 510 of the main body bag portion 502, while in a similar manner, the edge portion of the pleated or gusseted member 534, which is remote from the fold line 536, is also integrally connected to the bottom or back side member 514 of the main body bag portion 502. Still yet further, in order to close and seal the upper open end region 528 of the main body bag portion 502, an adhesive closure strip 504 is adapted to be fixedly attached across the open end region 528 of the main body bag portion 502. More particularly, for example, a first half section 538 of the adhesive closure strip 504 is adapted to be adhesively secured to the external surface portion of the bottom or back side member 514 of the main body bag portion 502, the upper regions of the pair of oppositely disposed pleated or gusseted portions 530 of the main body bag portion 502 will then be compressed or compacted together such that the upper regions of the first and second inwardly folded pleated or gusseted members 532, 534 come into full surface contact with each other, and in a similar manner, the upper edge portions 524 and 522 of the top or front side member 510 and the bottom or back side member 514 will also engage each other, and lastly, the adhesive closure strip 504 will be folded upwardly along its laterally or transversely extending fold line 512 such that the second half section 540 of the adhesive closure strip 504 can effectively be folded over the mated upper edge portions 524 and 522 of the top or front side member 510 and the bottom or back side member 514 and adhesively secured to the external surface portion of the top or front side member 510 of the main body bag portion 502. It is to be noted that the width dimension of the adhesive closure strip 504 is preferably greater than the width dimension of the main body bag portion 502 so as to in fact maintain the upper regions of the side pleated or gusseted portion 530 at their compressed or compacted state so as to provide enhanced reinforcement and sealing of the bulk material product bag 500.

Figure 7:
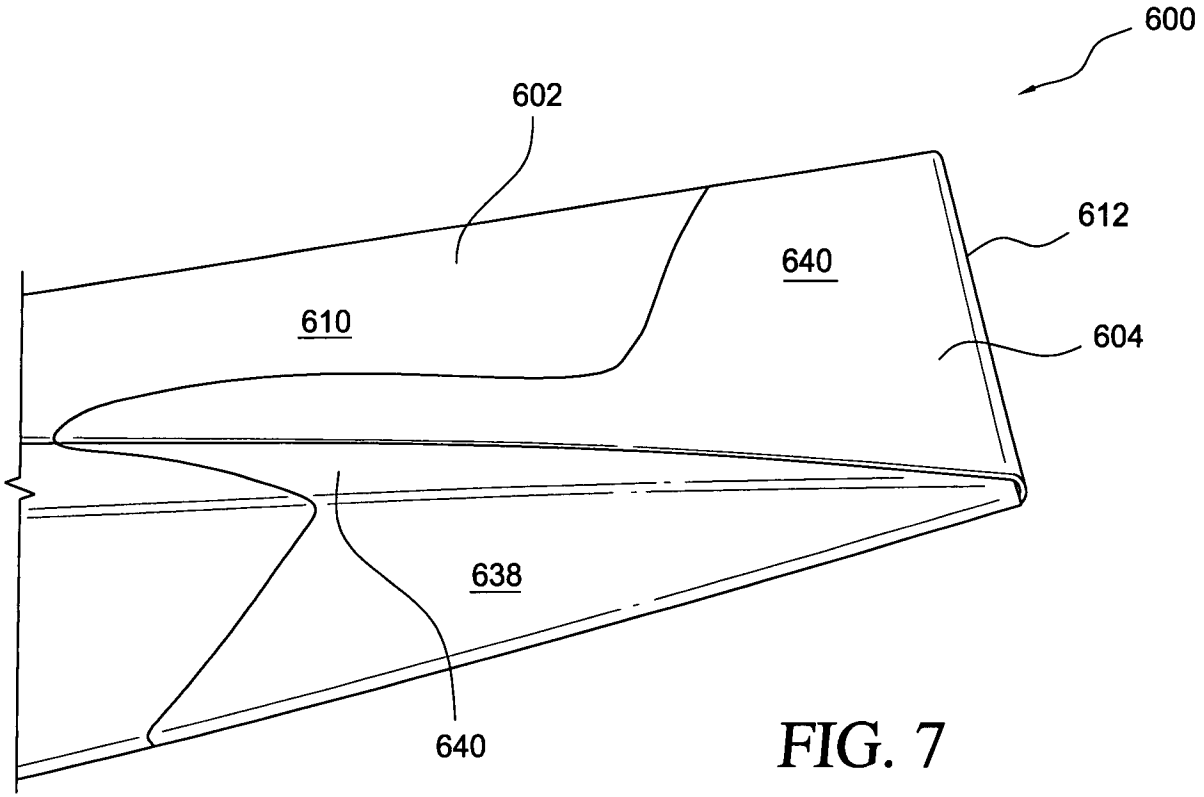
FIG. 7 is a side perspective view of a fourth embodiment of a new and improved flush-cut, gusseted bulk material product bag, as constructed in accordance with the principles and teachings of the present invention and showing the cooperative parts thereof, wherein the adhesive closure strip has been fixedly secured to the back side or undersurface portion of, for example, the upper open end region of the bulk material product bag, as well as to the front side surface portion of the bulk material product bag as a result of the folding over of the adhesive closure strip, and in addition, side portions of the adhesive closure strip have also been secured to internal surface portions of the gussets or pleats of the bulk material product bag so as to fixedly attach the adhesive closure strip across the upper open end region of the bulk material product bag in a closed and sealed manner.

Referring now to FIG. 7, a fourth embodiment of a new and improved flush-cut, gusseted bag, which may be, for example, a bulk material product bag, as constructed in accordance with the principles and teachings of the present invention and showing the cooperative parts thereof, is disclosed and is generally indicated by the reference character 600. It is noted that the fourth embodiment bulk material product bag 600 is effectively a modified embodiment of the third embodiment bulk material product bag 500 as illustrated within FIG. 6, and accordingly, in view of the similarity of the fourth embodiment bulk material product bag 600, as compared to, for example, the third embodiment bulk material product bag 500 as illustrated within FIG. 6, except as will be noted hereinafter in accordance with the teachings and principles of the present invention, component parts of the fourth embodiment bulk material product bag 600 which correspond to the component parts of the third embodiment bulk material product bag 500 will be designated by corresponding reference characters except that they will be within the 600 series.

More particularly, it is seen that the bulk material product bag 600 comprises a main body bag portion 602 that is formed by means of a top or front side member 610, a bottom or back side member, not visible, and a pair of oppositely disposed, inwardly folded pleated or gusseted members similar to the pleats or gussets 530 of the bulk material product bag 500. The primary difference between the fourth embodiment bulk material product bag 600, as illustrated in FIG. 7, and the third embodiment bulk material product bag 500, as illustrated within FIG. 6, resides in the mode or manner that the adhesive closure strip 640 of the bulk material product bag 600 is secured across, for example, originally open upper end region of the bulk material product bag 600. More particularly, in lieu of the adhesive closure strip 604 simply being, in effect, folded over upon itself with side portions of the adhesive closure strip 604 extending beyond the side edge portions of the main body bag portion 602 when the width dimension of the adhesive closure strip 604 is greater than the width dimension of the main body bag portion 602, the side edge portions of the first and second half sections 638,640 of the adhesive closure strip 604 are effectively folded inwardly so as to respectively cover or be adhesively bonded to the external surface portions of the upper end regions of the pleated or gusseted portions of the bulk material product bag 600 in order to, again, provide enhanced reinforcement and sealing to the bulk material product bag 600.

Figure 8:
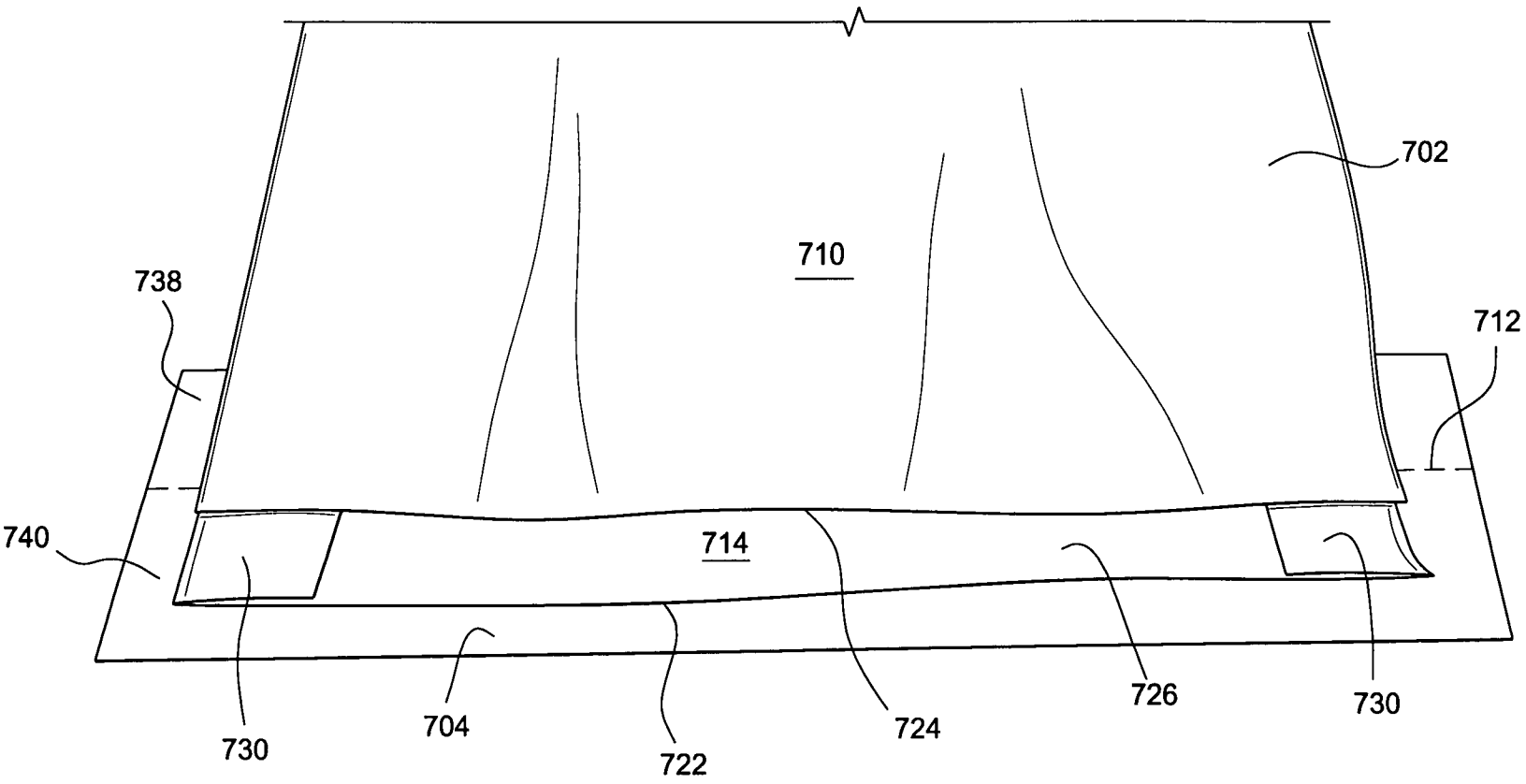
FIG. 8 is a front side perspective view of a fifth embodiment of a new and improved pinch-bottom, gusseted bulk material product bag, as constructed in accordance with the principles and teachings of the present invention and showing the cooperative parts thereof, wherein the adhesive closure strip has been fixedly secured to the back side or undersurface portion of, for example, the upper open end region of the bulk material product bag, and is adapted to be folded over, along with the upper end flap portion of the bulk material product bag, such that the adhesive closure strip can be fixedly secured onto the front side surface portion of the bulk material product bag.
Figure 9:
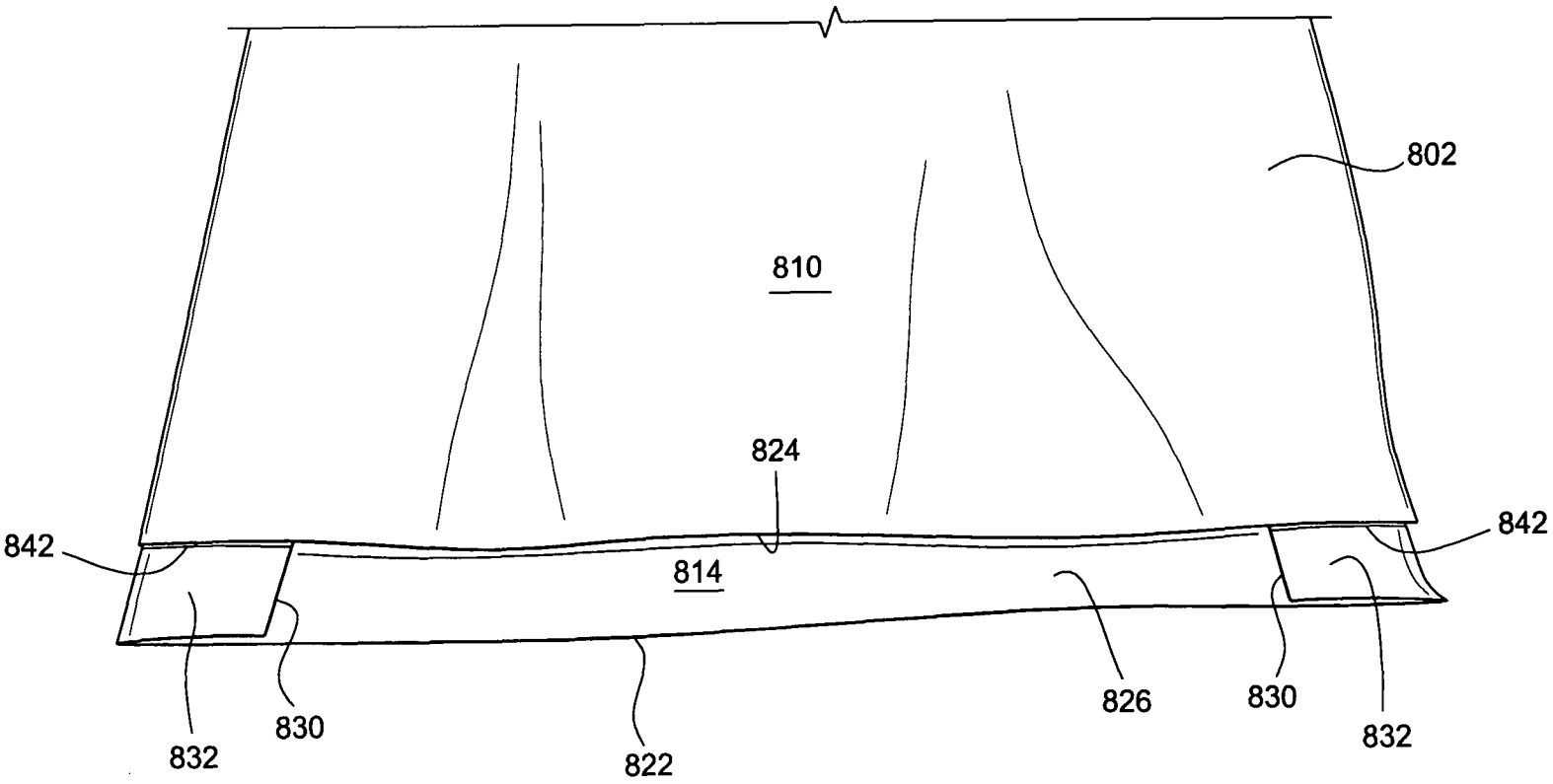
FIG. 9 is a front side perspective view, similar to that of FIG. 8, showing, however, a sixth embodiment of a new and improved pinch-bottom, gusseted bulk material product bag, as constructed in accordance with the principles and teachings of the present invention and showing the cooperative parts thereof, wherein, in order to close and seal the bulk material product bag by means of the adhesive closure strip, portions of the side gussets or pleats, within the vicinity of, for example, the open upper end region of the bulk material product bag, are to be initially cut so as to form securing tab members therefrom which will be adapted to be folded over and secured to the back side surface portion of the bulk material product bag when the upper end flap portion of the bulk material product bag is folded over onto the front side member of the bulk material product bag and the adhesive closure strip is folded over onto the back side member of the bulk material product bag in order to close and seal the same.

With reference now being made to FIG. 8, a fifth embodiment of a new and improved pinch-bottom, gusseted bag, which may be, for example, a bulk material product bag, as constructed in accordance with the principles and teachings of the present invention and showing the cooperative parts thereof, is disclosed and is generally indicated by the reference character 700. It is noted that the fifth embodiment bulk material product bag 700 is similar to the second embodiment bulk material product bag 400 as illustrated within FIG. 5, and accordingly, in view of the similarity of the fifth embodiment bulk material product bag 700, as compared to, for example, the second embodiment bulk material product bag 400 as illustrated within FIG. 5, except as will be noted hereinafter in accordance with the teachings and principles of the present invention, component parts of the fifth embodiment bulk material product bag 700 which correspond to the component parts of the second embodiment bulk material product bag 400 will be designated by corresponding reference characters except that they will be within the 700 series. More particularly, it is seen that in accordance with the principles and teachings of the fifth embodiment bulk material product bag 700, the same comprises a pinch-bottom bag wherein the top or front side member 710 is longitudinally offset with respect to the bottom or back side member 714 such that a pair of upper and lower flap members are effectively defined thereby, only the upper flap member 726 being illustrated. Continuing further, it is appreciated that the primary difference between the fifth embodiment bulk material product bag 700, as compared to, for example, the second embodiment bulk material product bag 400 as illustrated within FIG. 5, resides in the fact that the fifth embodiment bulk material product bag 700 comprises a pair of oppositely disposed, inwardly folded side edge pleats or gussets 730.

Accordingly, when, for example, the originally open upper end portion of the main body bag portion 702 of the bulk material product bag 700 is to be closed and sealed, a first half section 738 of a closure strip 704 is fixedly attached or secured to the external surface portion of the bottom or back side member 714 of the upper open end region of the main body bag portion 702 of the bulk material product bag 700, and subsequently, the adhesive closure strip 704, along with, for example, the upper flap member 726 of the main body bag portion 702 and those portions of the pleats or gussets which project beyond the upper edge portion 724 of the top or front side member 710, are folded over upon themselves so as to permit the second half section 740 of the adhesive closure strip 704 to be fixedly secured onto the external surface portion of the top or front side member 710 of the main body bag portion 702 of the bulk material product bag 700. It is therefore to be appreciated still further that those portions of the pleats or gussets that project beyond the upper edge portion 724 of the top or front side member 710 are effectively entrapped, encased, or encapsulated in a compressed or compacted state, between the upper flap member 726 and the upper external surface portion of the top or front side member 710, whereby the originally open upper end region of the main body bag portion 702 of the bulk material product bag 700 is now closed and sealed. Adhesive closure strip structure, similar to the closure strip structure 704, can likewise be applied to the originally open lower end region of the main body bag portion 702 of the bulk material product bag 700 in order to likewise close and seal the same.

Referring now to FIGS. 9-14, a sixth embodiment of a new and improved pinch-bottom, gusseted bag, which may be, for example, a bulk material product bag, as constructed in accordance with the principles and teachings of the present invention and showing the cooperative parts thereof, is disclosed and is generally indicated by the reference character 800. It is noted that the sixth embodiment bulk material product bag 800 is similar in structure to the fifth embodiment bulk material product bag 700 as illustrated within FIG. 8, and accordingly, in view of the similarity of the sixth embodiment bulk material product bag 800, as compared to the fifth embodiment bulk material product bag 700 as illustrated within FIG. 8, except as will be noted hereinafter in accordance with the teachings and principles of the present invention, component parts of the sixth embodiment bulk material product bag 800 which correspond to the component parts of the fifth embodiment bulk material product bag 700 will be designated by corresponding reference characters except that they will be within the 800 series. More particularly, while the basic structure of the sixth embodiment bulk material product bag 800 is substantially the same as that of the fifth embodiment bulk material product bag 700 as illustrated within FIG. 8, the primary difference between the two bulk material product bags 700,800 resides in the method of closing the same.

Figure 10:
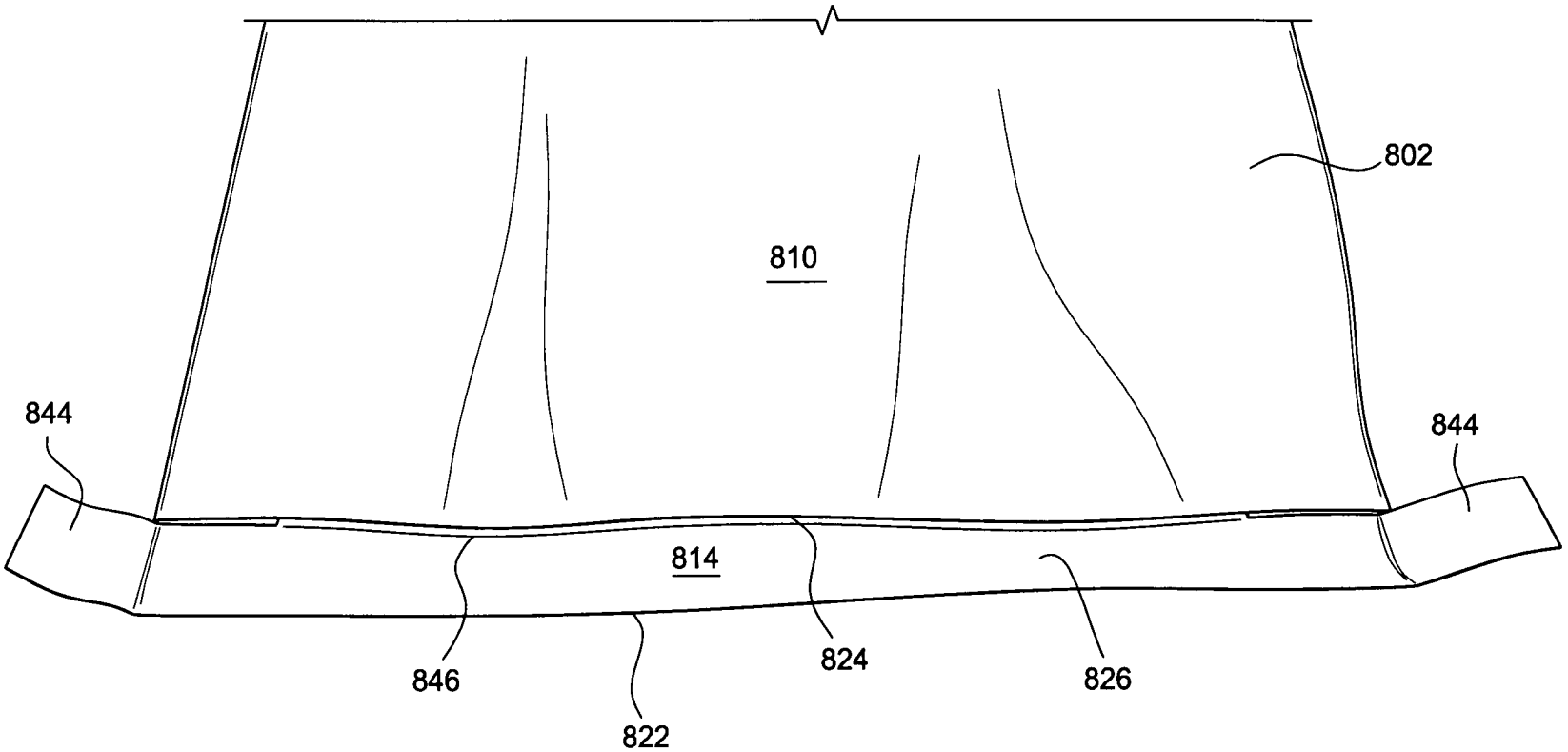
FIG. 10 is a front side perspective view of the sixth embodiment bulk material product bag as disclosed within FIG. 9, showing, however, the upper portions of the side gussets or pleats, within the vicinity of, for example, the open upper end region of the bulk material product bag, having been cut and unfolded so as to form the securing tab members which now project outwardly from the side edge portions of the bulk material product bag.
Figure 11:
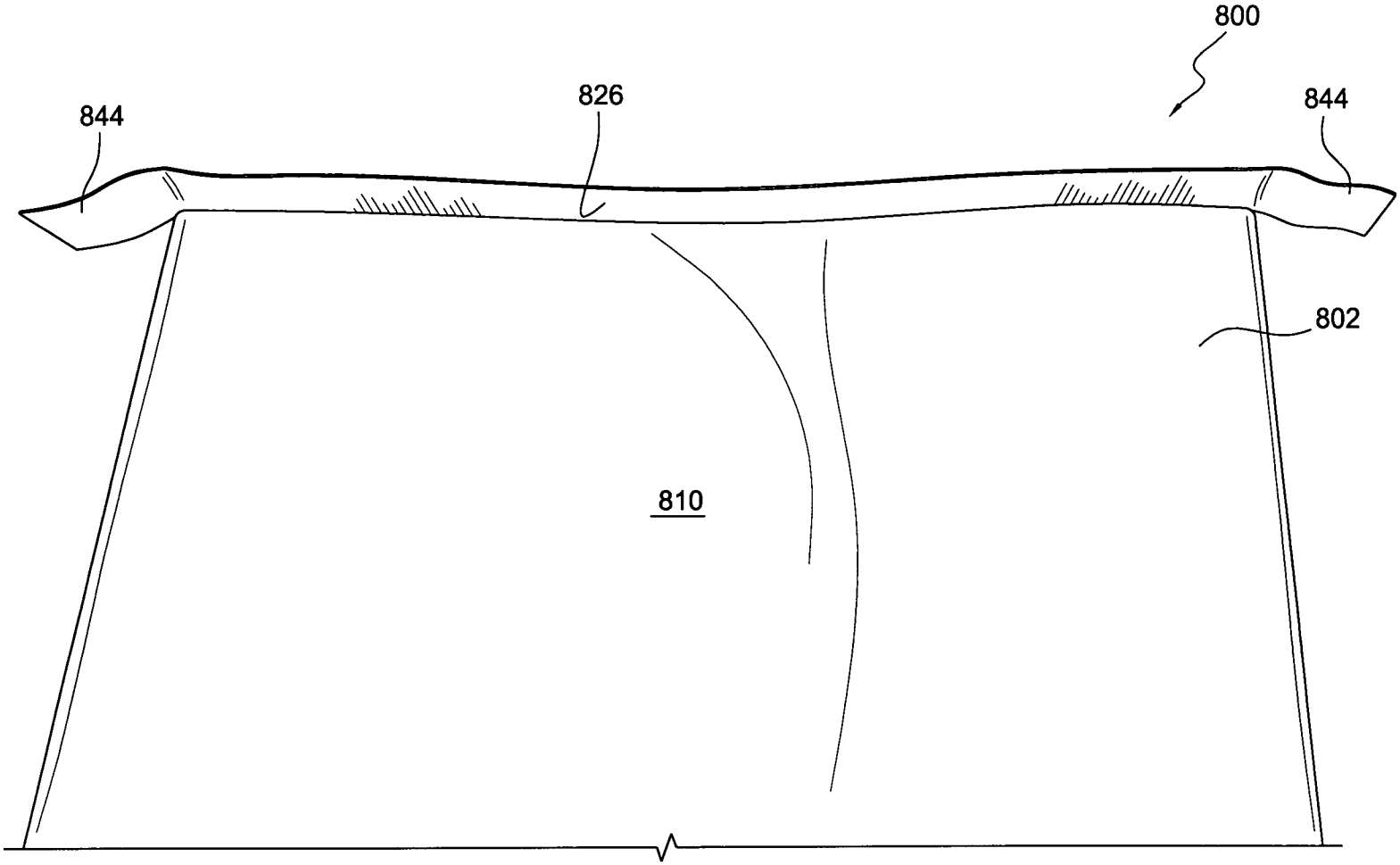
FIG. 11 is a front side perspective view of the sixth embodiment bulk material product bag as disclosed within FIGS. 9 and 10, but viewed from, for example, the lower end region of the bulk material product bag and showing the upper flap portion of the bulk material product bag, and the securing tab members integrally connected thereto, folded over onto the front side member of the bulk material product bag.
Figure 12:
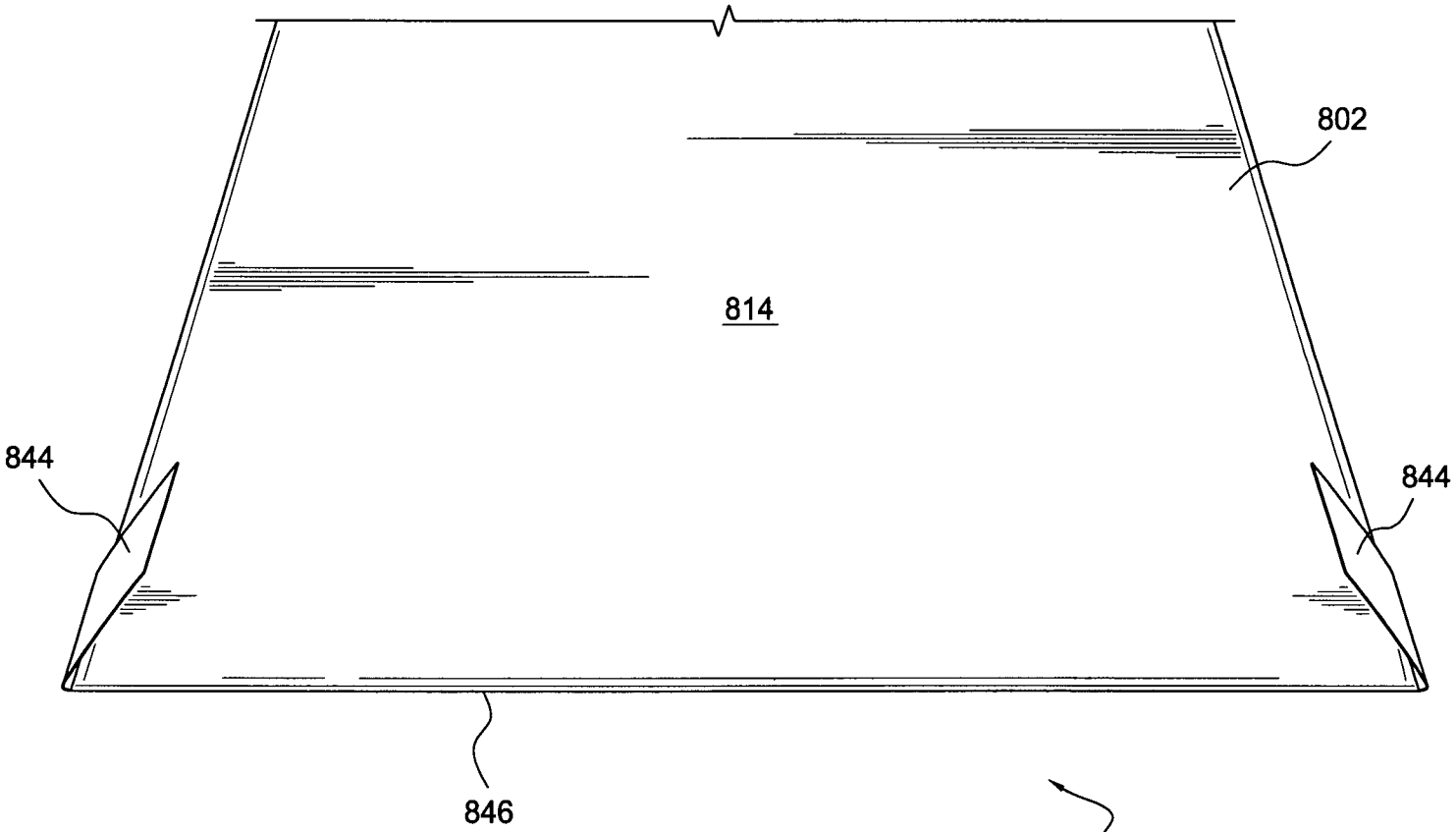
FIG. 12 is a perspective view, similar to that of FIGS. 9 and 10, showing, however, the securing tabs having been folded over onto the back side member of the bulk material product bag.

For example, in lieu of simply entrapping, encasing, or encapsulating the upper portions of the pleats or gussets 830, 830 between the upper flap member 826 and the upper external surface portion of the top or front side member 810, as was the case with the upper portions of the pleats or gussets 730,730, the upper portions of the first inwardly folded pleated or gusseted members 832,832 are initially cut or slit along transversely oriented lines 842 whereby the cut or slit portions can now effectively be unfolded laterally outwardly so as to form laterally outwardly projecting or extending tab members 844,844 as can best be seen in FIG. 10. Subsequently, as can best be appreciated from FIG. 11, the upper flap member 826 is folded along its fold line 846 so as to now be disposed in surface-to-surface contact with the upper external surface portion of the top or front side member 810 of the main body bag portion 802 while the tab members 844, 844 still project or extend laterally outwardly. Subsequently, still further, as can best be appreciated from FIG. 12, the tab members 844,844 are now folded laterally inwardly so as to be adapted to be disposed in surface-to-surface contact with the upper external surface portion of the bottom or back side member 814 of the main body bag portion 802.

Figure 13:
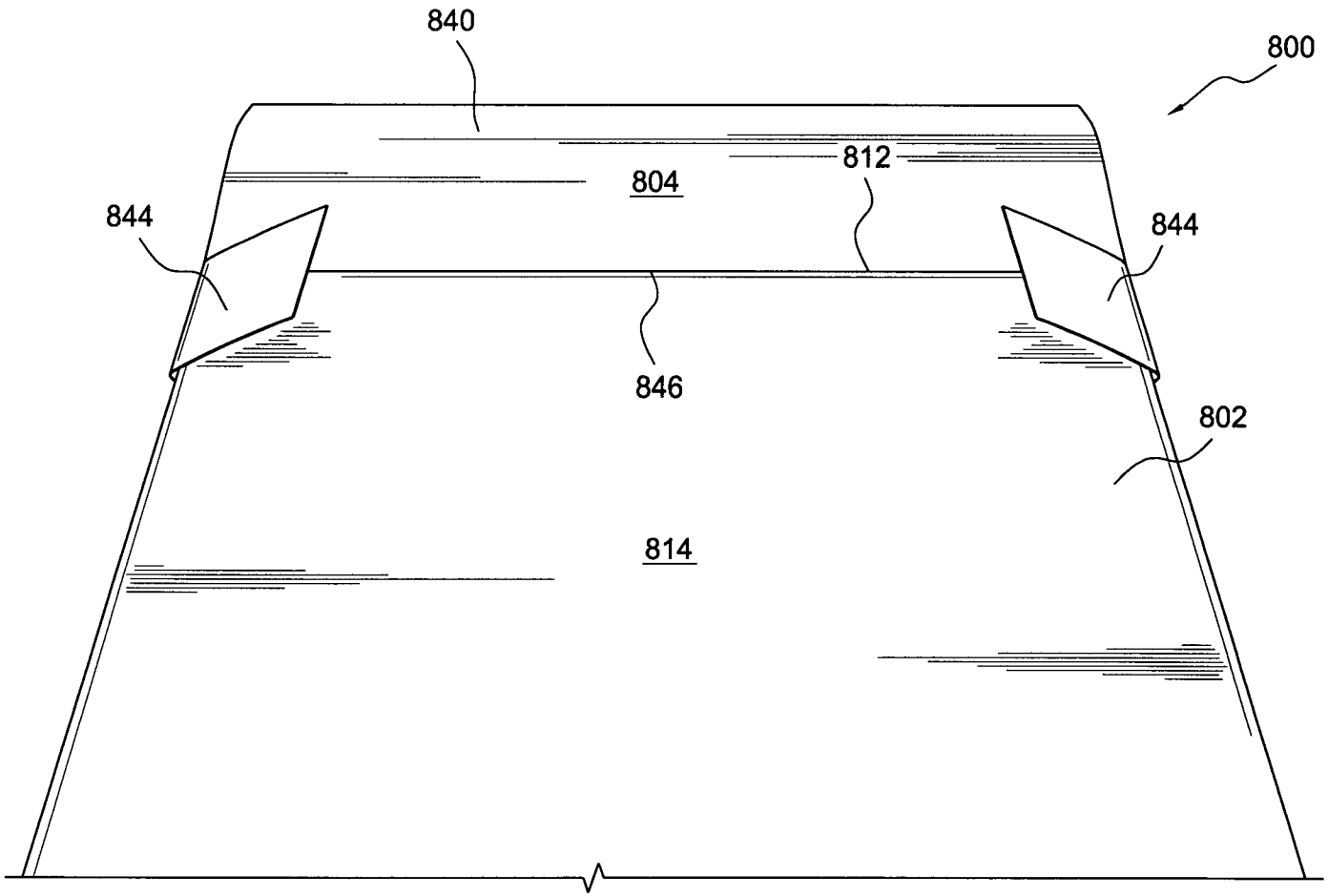
FIG. 13 is a perspective view, similar to that of FIG. 11, showing, however, the adhesive closure strip having been secured to the front side member of the bulk material product bag and being readied to be folded over onto the back side member of the bulk material product bag so as to entrap the folded securing tabs beneath the folded adhesive closure strip and thereby close and seal the bulk material product bag.
Figure 14:
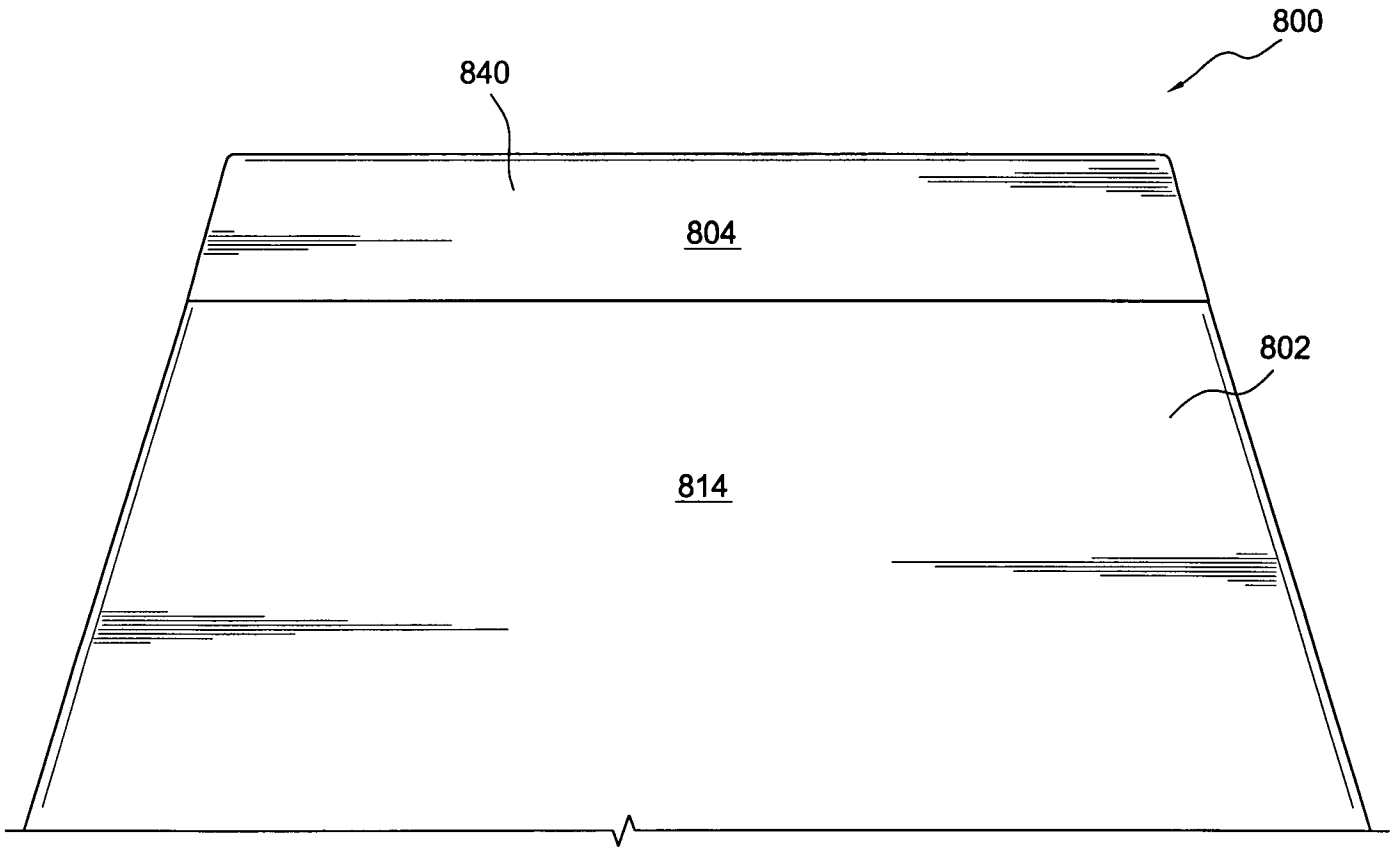
FIG. 14 is a perspective view, similar to that of FIG. 13, showing, however, the adhesive closure strip folded over onto the back side surface portion of the bulk material product bag so as to cover the folded securing tabs and thereby complete the closure and sealing of the bulk material product bag.

Then, as can best be appreciated from FIG. 13, an adhesive closure strip 804 has its first section, not visible, adhesively bonded to the upper external surface portion of the top or front side member 810 and is subsequently folded over at its fold line 812 so as to be adhesively bonded to the upper external surface portion of the bottom or back side member 814 of the main body bag portion 802 of the bulk material product bag 800, thereby entrapping, encasing, or encapsulating the tab members 844,844 between the internal adhesive surface of the second section 840 of the adhesive closure strip 804 and the upper external surface portion of the bottom or back side member 814 of the main body bag portion 802 of the bulk material product bag 800. The originally open upper region of the bulk material product bag 800 is now closed and sealed. It is lastly noted in connection with this method of fabricating the closed and sealed bulk material product bag 800 that when the upper flap member 826 is folded onto the upper external surface portion of the top or front side member 810 of the main body bag portion 802 as disclosed within FIG. 11, and when the tab members 844,844 are folded onto the upper external surface portion of the bottom or back side member 814 as disclosed within FIG. 12, suitable adhesive may be applied to the internal surface portions of the upper flap member 826 and the tab members 844,844 so as to respectively secure the same at their folded states prior to the fixation of the adhesive closure strip 804 to the bulk material product bag 800 as illustrated within FIGS. 13 and 14. Alternatively, if preferred, the adhesive closure strip 804 can be omitted since the upper flap member 826 and the tab members 844,844 have already been adhesively bonded to their respective portions of top or front, and bottom or back, side members 810,814 of the bulk material product bag 800.

Figure 3:
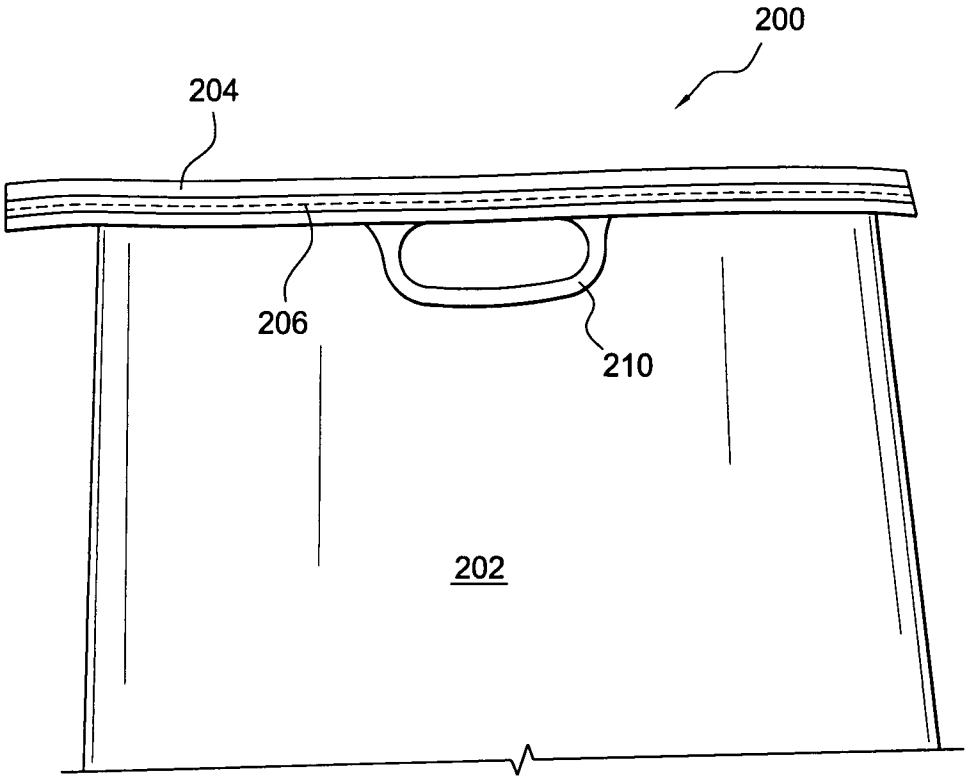
FIG. 3 (PRIOR ART)
FIG. 3 is a front elevational view of a conventional PRIOR ART bulk material product bag which is similar to the bulk material product bag as disclosed within FIG. 1, however, in addition to, for example, its upper end portion of the bag being closed by means of a closure strip which is secured thereto by means of sewn stitching, handle structure is also affixed to the upper end portion of the bulk material product bag by means of the aforenoted sewn stitching.
Figure 15:
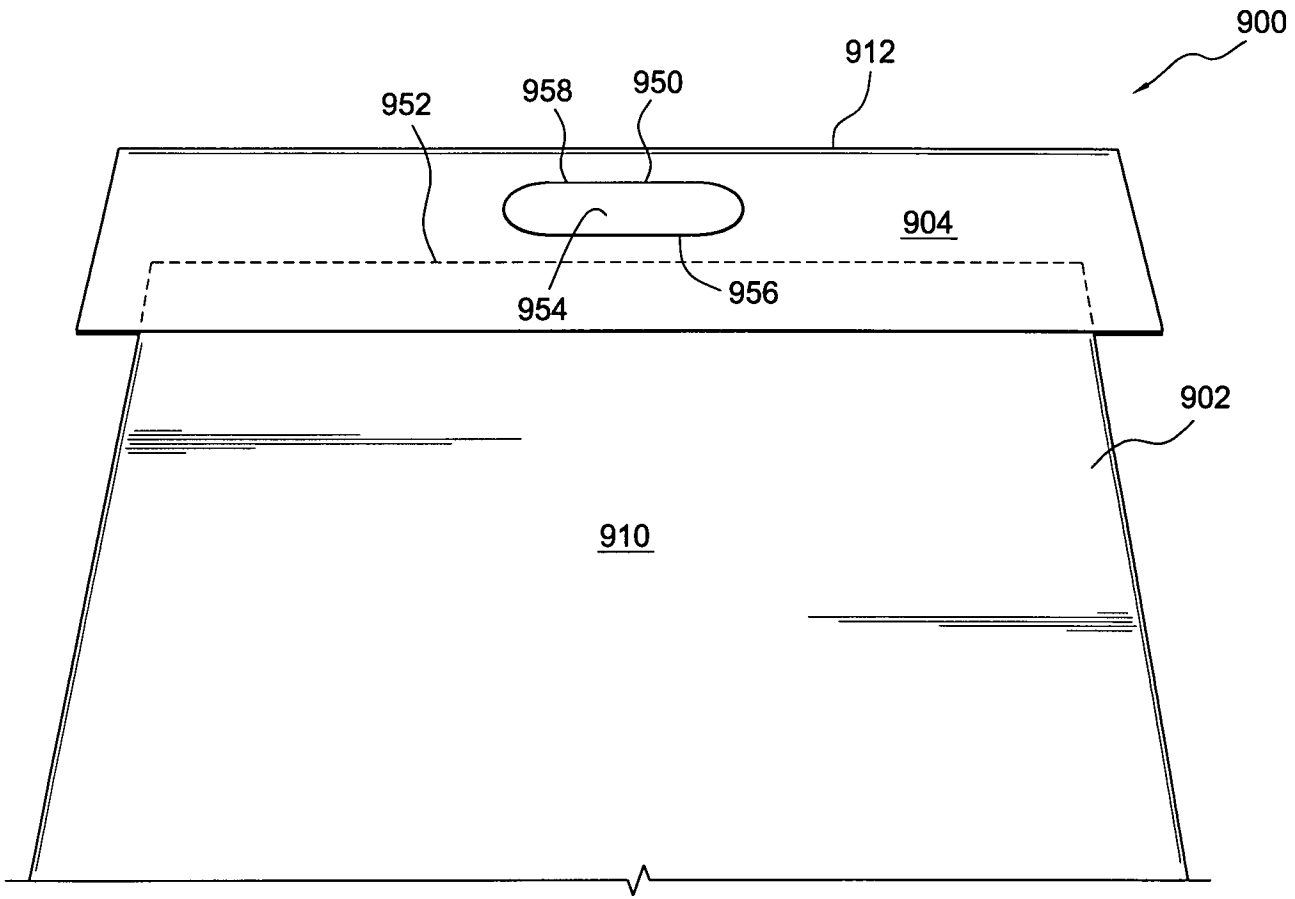
FIG. 15 is a front elevational view, similar to that of FIG. 4, showing, however, a seventh embodiment of a new and improved bulk material product bag wherein handle structure is integrally incorporated within the adhesive closure strip.

With reference lastly being made to FIG. 15, a seventh embodiment of a new and improved bag, which may be, for example, a flush-cut or pinch bottom bulk material product bag, with or without side pleats or gussets, as is constructed in accordance with the principles and teachings of the present invention and which shows the cooperative parts thereof, is disclosed and is generally indicated by the reference character 900. It is noted that the seventh embodiment bulk material product bag 900 is broadly similar in structure to the first embodiment bulk material product bag 300 as illustrated within FIG. 4, and accordingly, in view of the similarity of the seventh embodiment bulk material product bag 900, as compared to the first embodiment bulk material product bag 300 as illustrated within FIG. 4, except as will be noted hereinafter in accordance with the teachings and principles of the present invention, component parts of the seventh embodiment bulk material product bag 900 which correspond to the component parts of the first embodiment bulk material product bag 300 will be designated by corresponding reference characters except that they will be within the 900 series. More particularly, it is often desired to integrally incorporate handle structure into or onto a bulk material product bag in order to facilitate the carrying or transporting of the same. The drawbacks and disadvantages of conventionally handled bulk material product bags has been previously discussed in connection with the bulk material product bag 200 as disclosed within FIG. 3, so, in accordance with the principles and teachings of the present invention, it is seen that handle structure 950 is integrally incorporated in or upon the bulk material product bag 900 as a result of effectively being punched out within the upper region of the bulk material product bag 900. More specifically, it is seen that the handle structure 950 comprises an oval-shaped cut-out region, and it is particularly noted that the adhesive closure strip 904 can be applied across the upper region of the main body bag portion 902 in such a manner that the fold line 912 of the adhesive closure strip 904 is effectively spaced from the upper edge portion 952 of the main body bag portion 902 whereby the handle structure 950 is formed as a result of a portion 954 of the adhesive closure strip 904 being punched out and severed or separated from the residual portion of the adhesive closure strip 904.

Alternatively, the adhesive closure strip 904 can be applied across the upper region of the main body bag portion 902 in such a manner that the fold line 912 of the adhesive closure strip 904 is effectively disposed in lineal contact with the upper edge portion 952 of the main body bag portion 902 whereby the handle structure 950 is punched through both the adhesive closure strip 904 and the upper region of the main body bag portion 902. Alternatively still further, in lieu of the portion 954 actually being punched through, for example, the adhesive closure strip 904, so as to effectively form the handle structure 950, the periphery 956 of the portion 954 may simply be frangibly perforated, except for the uppermost long side portion, as at 958, whereby when the bulk material product bag 900 is to be used with the handle structure 950, pushing forces may simply be exerted upon the portion 954 so as to cause the perforations to break whereby the portion 954 can effectively be pushed through the periphery and folded back upon itself so as to define the handle structure 950 through which a person can then carry the bulk material product bag 900.

Thus, it may be seen that in accordance with the teachings and principles of the present invention, various embodiments of a new and improved bulk material product bag have been disclosed wherein the bulk material product bag has an adhesive closure strip fixedly secured thereon. As a result of the adhesive closure strip being oriented transversely across the open end region of the bulk material product bag so as to be adhesively bonded to both the back and front sides of the bulk material product bag, the adhesive closure strip effectively closes and seals the open end region of the bulk material product bag. Lastly, handle structure can be integrally incorporated or defined within the adhesive closure strip.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A product bag comprising:

a main body bag comprising a pinch-bottom bag having a predetermined longitudinal extent wherein first and second sheet members have substantially the same length dimensions but are longitudinally offset with respect to each other so as to effectively form end flap members at opposite ends of said main body bag portion, wherein each end flap member of one of said first and second sheet members comprises a transversely extending edge portion to be folded over onto external surface portions of the other one of said first and second sheet members and secured to said external surface portion of said other one of said first and second sheet members as a result of at least one of said end flap members of a first one of said first and second sheet members being adhesively bonded to said external surface portion of said second one of said first and second sheet members, and wherein further said main body bag comprises a gusseted bag wherein opposite sides of said product bag comprise folded pleated portions;

wherein said folded pleated portions of said opposite sides of said product bag comprise a single set of tab members which extend transversely and outwardly from opposite sides of said end flap member of a first one of said first and second sheet members forming one of said folded pleated portions such that a transversely extending edge portion of each one of said tab members is coincident with said transversely extending edge portion of said flap member, and wherein, after said end flap member of said first one of said first and second sheet members has been folded over said second one of said first and second sheet members, said single set of tab members, extending transversely outwardly from opposite sides of said end flap member of said first one of said first and second sheet members, can be folded transversely inwardly so as to wrap around said opposite sides of said second one of said first and second sheet members so as to engage said external surface portion of said first one of said first and second sheet members; and a closure strip folded over upon itself such that a first portion of said folded closure strip is adhesively bonded to an external surface portion of one of said first and second sheet members within the vicinity of said normally open end of said main body bag portion, while a second portion of said folded closure strip is adhesively bonded to an external surface portion of the other one of said first and second sheet members within the vicinity of said normally open end of said main body bag portion so as to envelop said inwardly folded tab members and thereby close and seal said normally open end of said main body bag portion.

2. The product bag set forth in claim 1, wherein:

said main body bag portion has a first predetermined width dimension; and said closure strip has a second predetermined width dimension which is greater than said first predetermined width dimension of said main body bag portion such that opposite end portions of said closure strip extend beyond opposite side edge portions of said main body bag portion within said vicinity of said normally open end of said main body bag portion so as to encapsulate said opposite side edge pleated portions of said main body bag portion which are compressed together within said vicinity of said normally open end of said main body bag portion, when said closure strip is adhesively bonded across said normally open end of said main body bag portion, so as to enhance the closed sealing of said normally open end of said main body bag portion.

* * * * *